US009995117B2

(12) United States Patent
Snitkoff et al.

(10) Patent No.: US 9,995,117 B2
(45) Date of Patent: Jun. 12, 2018

(54) SELF-LOCKING SLURRY TUBE CONNECTOR AND PROTECTION ARRANGEMENT

(71) Applicants: Joshua Raymond Snitkoff, Houston, TX (US); Elmer Richard Peterson, Porter, CT (US); Roy Woudwijk, Spring, TX (US)

(72) Inventors: Joshua Raymond Snitkoff, Houston, TX (US); Elmer Richard Peterson, Porter, CT (US); Roy Woudwijk, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 139 days.

(21) Appl. No.: 15/092,175

(22) Filed: Apr. 6, 2016

(65) Prior Publication Data

US 2017/0292352 A1 Oct. 12, 2017

(51) Int. Cl.

| | |
|---|---|
| ***E21B 43/04*** | (2006.01) |
| ***E21B 17/02*** | (2006.01) |
| ***E21B 17/18*** | (2006.01) |
| ***E21B 43/08*** | (2006.01) |

(52) U.S. Cl.
CPC ..... *E21B 43/08* (2013.01); *E21B 43/045* (2013.01)

(58) Field of Classification Search
CPC ..... A61M 2039/1066; E21B 43/04; E21B 17/02; E21B 43/045; E21B 43/08; E21B 43/088; E21B 41/00; E21B 17/18
See application file for complete search history.

(56) References Cited

U.S. PATENT DOCUMENTS

| | | | | |
|---|---|---|---|---|
| 5,868,200 | A * | 2/1999 | Bryant | E21B 43/04 166/242.3 |
| 2003/0159825 | A1* | 8/2003 | Hurst | E21B 41/00 166/278 |
| 2006/0283604 | A1 | 12/2006 | Setterberg et al. | |
| 2010/0059232 | A1* | 3/2010 | Langlais | E21B 17/02 166/380 |
| 2014/0015873 | A1 | 1/2014 | Kasai et al. | |
| 2014/0110131 | A1 | 4/2014 | Cunningham et al. | |
| 2014/0262332 | A1* | 9/2014 | McNamee | E21B 43/04 166/378 |
| 2015/0226040 | A1* | 8/2015 | McNamee | E21B 43/08 166/278 |
| 2015/0233216 | A1 | 8/2015 | Rodrigue et al. | |
| 2015/0345257 | A1 | 12/2015 | Veit | |
| 2017/0058647 | A1* | 3/2017 | Langlais | E21B 43/045 |

OTHER PUBLICATIONS

Dinh, Diane; "Shunt Tube Assembly Product No. 486-42"; Interim Field Run Report; Baker Hughes, Inc; May 1995; 5 Pages.
Notification of Transmittal of the International Search Report and the Written Opinion of the International Searching Authority, or the Declaration; PCT/US2017/020373; dated Jun. 15, 2017: 10 pages.

* cited by examiner

*Primary Examiner* — Kipp C Wallace
(74) *Attorney, Agent, or Firm* — Cantor Colburn LLP

(57) ABSTRACT

A Self-Locking Slurry Tube Connector and Protection Arrangement includes a jumper tube; a tube cover supporting and protective of the jumper tube. A connector sealed to the jumper tube and configured to move on the jumper tube from a first position to a second automatically locked position. A method for joining slurry tubes between adjacent sand screens.

11 Claims, 5 Drawing Sheets

SELF-LOCKING SLURRY TUBE CONNECTOR AND PROTECTION ARRANGEMENT

BACKGROUND

In downhole industries, it is often desirable to utilize a number of sand screen in gravel packing operations. The screens include joints of pipe having a number of components thereon including screen and slurry tubes that run the length of the joint. When running such sand screens, each joint is made up sequentially to the one before it ensuring the slurry tubes are aligned. Jumper tubes are then placed between the aligned slurry tubes and connectors are dragged into place and screwed to the slurry tubes. This assembly then must be protected with a shroud which must be installed and secured after the jumper tubes are connected and secured. While the system is well known, has been used for more than a decade and works well for its intended purpose, it is tedious and time consuming to install. Since sand screen sections of strings in boreholes tend to be thousands of feet long and individual joints are 30 feet long, the number of times the process must be repeated can be quite high. The time it takes to achieve appropriate results using this system adds up to a significant period that could be days. With rig time running into the hundreds of thousands of dollars per day, expense associated with this system is appreciable. Screens have been run this way for at least two decades without any improvement of the process. The art would therefore well receive alternatives that achieve acceptable results while reducing time associated with running a sand screen assembly.

BRIEF DESCRIPTION

A Self-Locking Slurry Tube Connector and Protection Arrangement includes a jumper tube; a tube cover supporting and protective of the jumper tube; and a connector sealed to the jumper tube and configured to move on the jumper tube from a first position to a second automatically locked position.

A method for joining slurry tubes between adjacent sand screens includes disposing an arrangement as a Self-Locking Slurry Tube Connector and Protection Arrangement includes a jumper tube; a tube cover supporting and protective of the jumper tube; and a connector sealed to the jumper tube and configured to move on the jumper tube from a first position to a second automatically locked position between adjacent sand screens; aligning the jumper tube with a slurry tube from each of the sand screens; sliding the connector from the first position on the jumper to the second position in sealing contact with the slurry tube and allowing the automatic locking of the connector in the second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
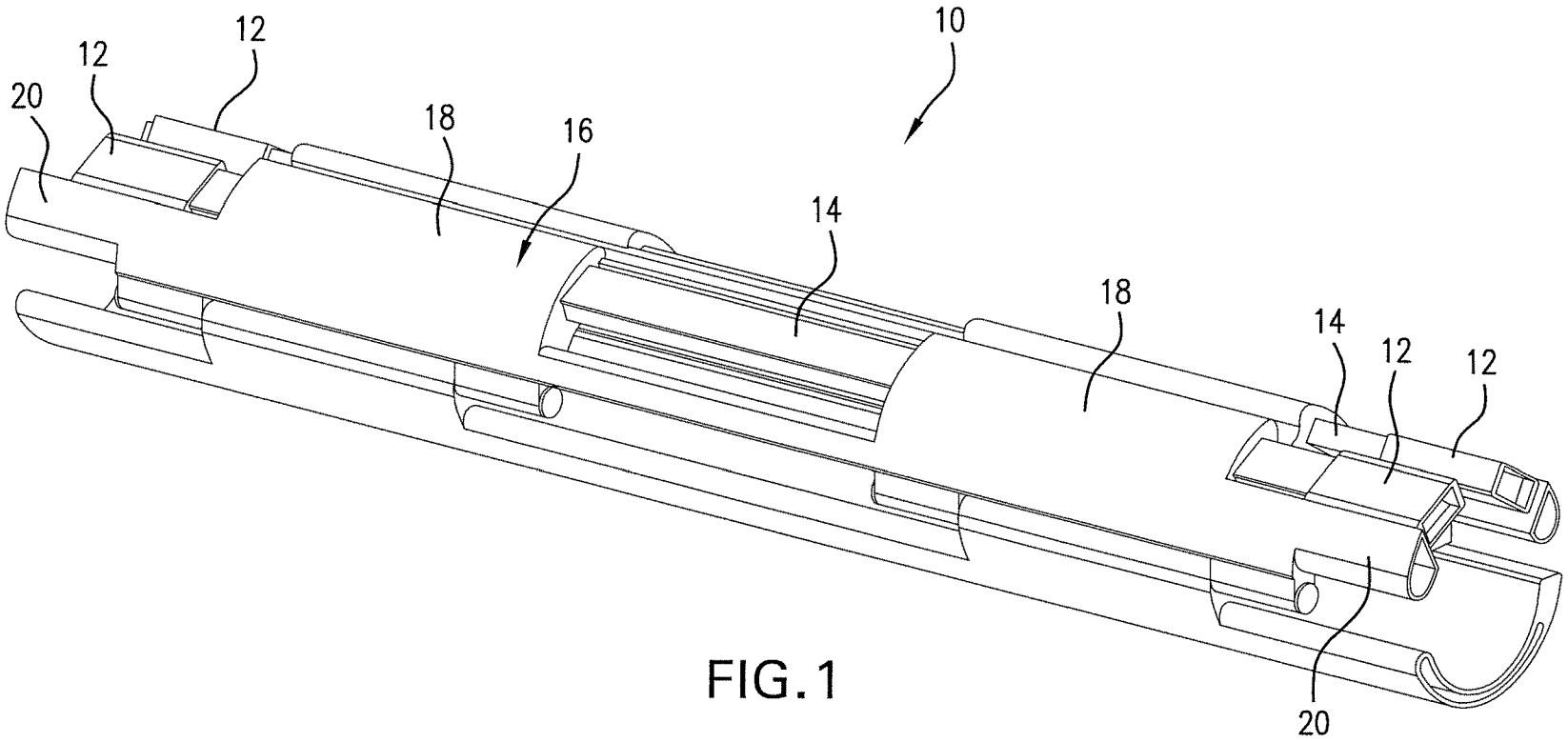
FIG. 1 is a perspective view of a Self-Locking Slurry Tube Connector and Protection Arrangement.
Figure 4:
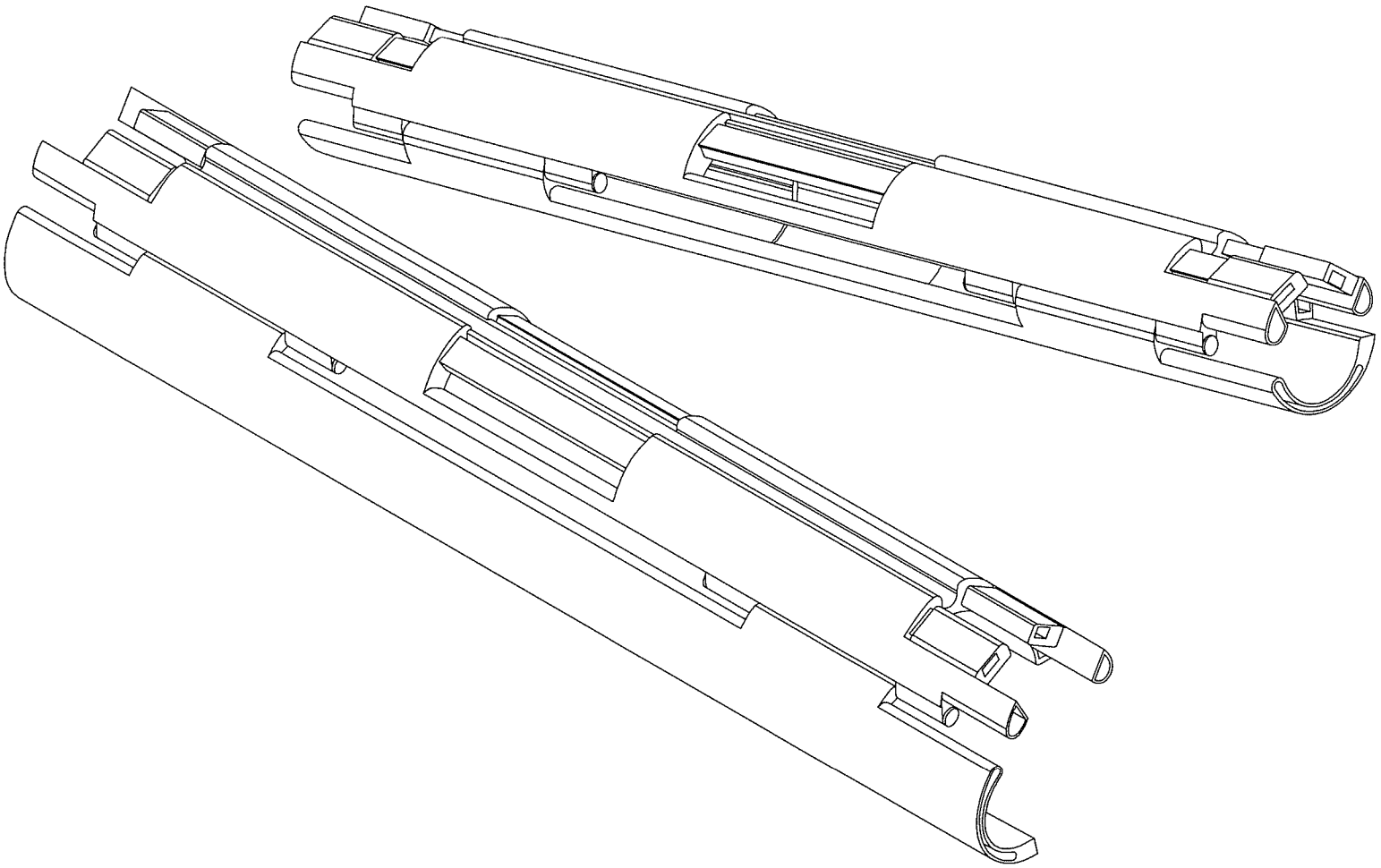
FIG. 4 is a perspective view of the arrangement of FIG. 1 in an open position prior to being clamped around a sand screen.

Referring to FIG. 1, a perspective view of a Self-Locking Slurry Tube Connector and Protection Arrangement 10 is illustrated. The arrangement 10 includes one or more connectors 12 (four shown) each slidably sealed to one or more jumper tubes 14 (two shown). The jumper tubes are mounted to a tube cover 16 at sections 18 that provide both protection to and support for the jumper tubes 14 while simultaneously being configured for light weight. The tube cover 16 may comprise plastic material and may be hollow. The tube cover 16 is attachable about a tubular such as a sand screen end in a clamshell manner (see FIG. 4) and securable by fasteners, not shown. In use the arrangement 10 is placed between two adjacent sand screens with their slurry tubes aligned and secured by fasteners.

Figure 2:
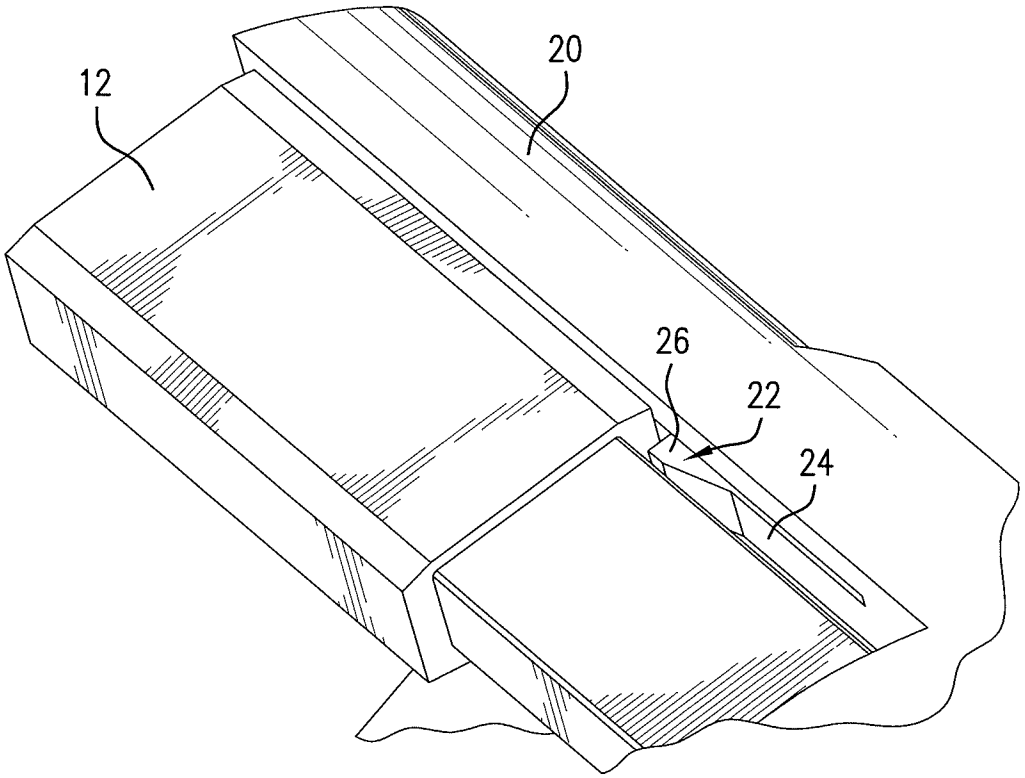
FIG. 2 is an enlarged perspective view of one of the connectors and detent from FIG. 1.

It will be appreciated from the illustration of FIG. 1 that the cover 16 near the connectors 12 includes projections 20. The projections 20 need not have a specific shape, the one illustrated being only one iteration, but in one embodiment are positioned and configured to support a locking detent 22 visible in FIG. 2 operably adjacent the connector 12. The detent 22 in one embodiment includes a deflectable finger 24 and a head 26. The projection 20 maintains the detent 22 in close enough proximity to the connector that the connector in a first position (shown in FIG. 1) will ride along the projection 20 with the detent deflected until the connector reaches a second position (shown in FIG. 2). Upon reaching the second position the connector 12 has traveled beyond the location of the detent 22 and the detent is then allowed to return to a natural position (it no longer being biased out of the way by the connector 12), will prevent the connector 12 from moving back to its first position. It is to be understood that the detent could also be positioned on the jumper tube and spring outwardly when the connector moves sufficiently axially that the connector itself no longer prevents the detent from springing outwardly. Then the connector would be automatically prevented from moving back to its first position quite similar to the discussed embodiment above.

Figure 3:
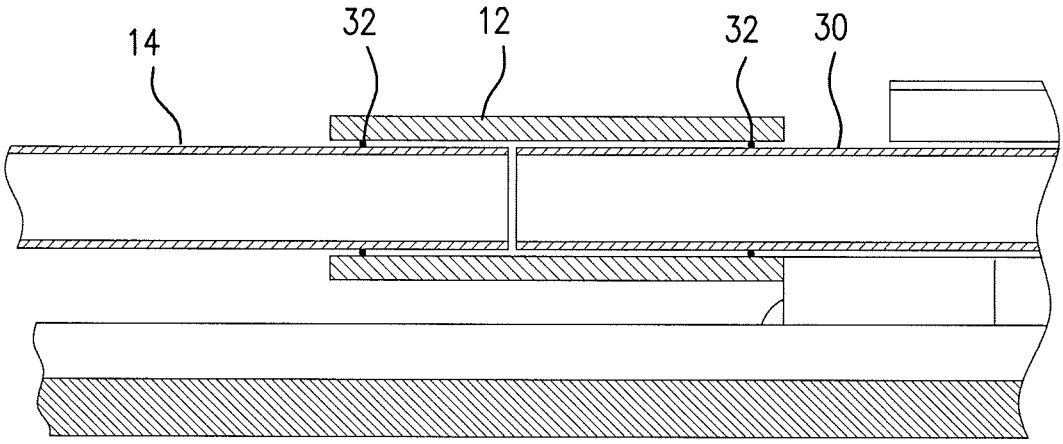
FIG. 3 is a cross sectional view of one of the connectors of FIG. 1 in a connected position.
Figure 5:
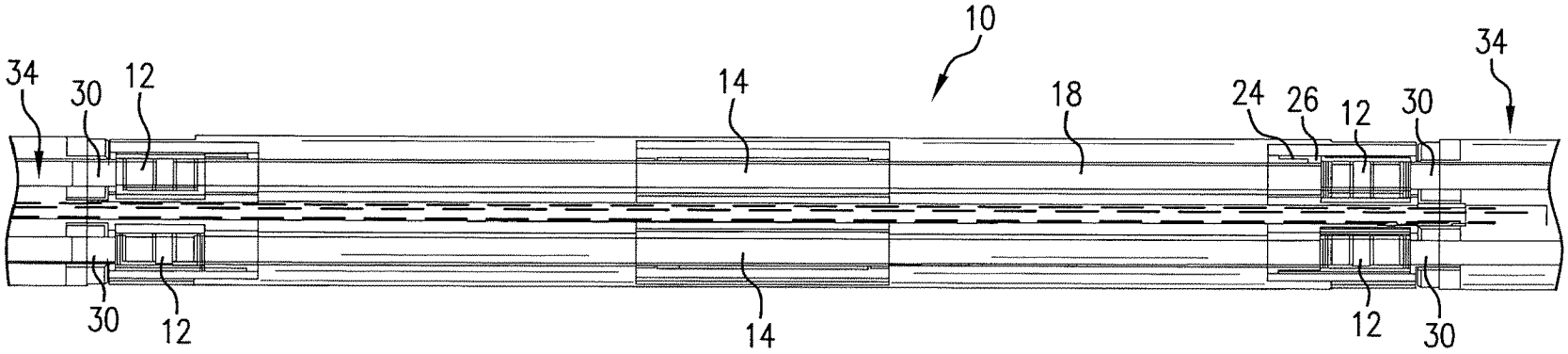
FIG. 5 is a view of the arrangement in final position on a sand screen.

In the connector first position, the arrangement is ready for use and waiting to be installed at an end of a sand screen joint. While being installed, the connector is moved by sliding motion into sealing contact with a slurry tube 30 of one of the two sand screens to which the arrangement is being connected. As the connector 12 reaches its second position the detent automatically ensures the connector will stay in that position where it is sealed to both the jumper tube 14 and the slurry tube 30. This is illustrated in cross section in FIG. 3 (schematically only) where the seals 32 (O-ring, etc.) between the connector 12 and the jumper tube 14 or the slurry tube 30 are also visible. At the other end of the jumper tube will be another connector 12 movable into sealing engagement (second seal) with the slurry tube 30 of the adjacent sand screen 34 (see FIG. 5).

Set forth below are some embodiments of the foregoing disclosure:

Embodiment 1

A Self-Locking Slurry Tube Connector and Protection Arrangement comprising: a jumper tube; a tube cover supporting and protective of the jumper tube; and a connector sealed to the jumper tube and configured to move on the jumper tube from a first position to a second automatically locked position.

Embodiment 2

The arrangement of embodiment 1 wherein the jumper tube is two jumper tubes each having a connector on each end of each jumper tube.

Embodiment 3

The arrangement of any prior embodiment wherein the tube cover is configured for light weight.

Embodiment 4

The arrangement of any prior embodiment wherein the tube cover is hollow.

Embodiment 5

The arrangement of any prior embodiment wherein the tube cover is a clamshell configuration.

Embodiment 6

The arrangement of any prior embodiment wherein the tube cover includes a projection having a detent appended therefrom, the detent causing the automatic locking of the connector in the second position.

Embodiment 7

The arrangement of any prior embodiment wherein the connector is sealed to the jumper by an o-ring.

Embodiment 8

The arrangement of any prior embodiment wherein the connector includes a second seal configured to interact with a sand screen slurry tube.

Embodiment 9

A sand screen system comprising two adjacent sand screens; an arrangement of any prior embodiment operatively adjoining the two adjacent sand screens.

Embodiment 10

A method for joining slurry tubes between adjacent sand screens comprising disposing an arrangement any prior embodiment between adjacent sand screens; aligning the jumper tube with a slurry tube from each of the sand screens; sliding the connector from the first position on the jumper to the second position in sealing contact with the slurry tube and allowing the automatic locking of the connector in the second position.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A self locking slurry tube connector and protection arrangement comprising:

a jumper tube;

a tube cover supporting and directly radially outwardly protective of the jumper tube;

a connector sealed to the jumper tube and configured to move on the jumper tube from a first position to a second automatically locked position; and an automatic lock supported by the tube cover and interactive with the connector to automatically lock the connector, wherein the automatic lock is movable with respect to the tube cover.

2. The arrangement as claimed in claim 1 wherein the jumper tube is two jumper tubes each having a connector on each end of each jumper tube.

3. The arrangement as claimed in claim 1 wherein the tube cover is configured for light weight.

4. The arrangement as claimed in claim 1 wherein the tube cover is hollow.

5. The arrangement as claimed in claim 1 wherein the tube cover has a clamshell configuration.

6. The arrangement as claimed in claim 1 wherein the tube cover includes a projection having a detent appended therefrom, the detent causing the automatic locking of the connector in the second position.

7. The arrangement as claimed in claim 1 wherein the connector is sealed to the jumper by an o-ring.

8. The arrangement as claimed in claim 1 wherein the connector includes a second seal configured to interact with a sand screen slurry tube.

9. A sand screen system comprising:

two adjacent sand screens;

an arrangement as claimed in claim 1 operatively adjoining the two adjacent sand screens.

10. A method for joining slurry tubes between adjacent sand screens comprising:

disposing an arrangement as claimed in claim 1 between adjacent sand screens;

aligning the jumper tube with a slurry tube from each of the sand screens;

sliding the connector from the first position on the jumper to the second position in sealing contact with the slurry tube and allowing the automatic locking of the connector in the second position.

11. A self locking slurry tube connector and protection arrangement comprising:

a jumper tube;

a tube cover supporting and directly radially outwardly protective of the jumper tube;

a connector sealed to the jumper tube and configured to move on the jumper tube from a first position to a second automatically locked position; and an automatic lock supported by the tube cover and interactive with the connector to automatically lock the connector, wherein the tube cover has a clamshell configuration.

* * * * *